US006474212B1

(12) United States Patent
Grazioli et al.

(10) Patent No.: US 6,474,212 B1
(45) Date of Patent: Nov. 5, 2002

(54) CARTRIDGE MAGAZINE

(75) Inventors: Mario Grazioli, Chur (CH); Gerhard Ehmig, Rankweil (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/639,591

(22) Filed: Aug. 16, 2000

(51) Int. Cl.[7] ..... F42B 39/08
(52) U.S. Cl. ..... 89/35.01; 89/1.14
(58) Field of Search ..... 89/35.01, 1.14; 227/10

(56) References Cited

U.S. PATENT DOCUMENTS

| | | | | | |
|---|---|---|---|---|---|
| 3,087,428 | A | * | 4/1963 | Frech | 102/39 |
| 3,410,213 | A | * | 11/1968 | Stadler et al. | 102/39 |
| 3,435,765 | A | * | 4/1969 | Gawlick | 102/39 |
| 3,625,154 | A | * | 12/1971 | Gawlick et al. | 102/86.5 |
| 4,036,103 | A | * | 7/1977 | Gawlick et al. | 89/35 |
| 4,056,062 | A | * | 11/1977 | Walser et al. | 102/86.5 |
| 4,098,169 | A | * | 7/1978 | Gawlick et al. | 89/35 |
| 4,410,124 | A | * | 10/1983 | Buechel | 227/9 |
| 4,611,738 | A | * | 9/1986 | Jochum | 227/9 |
| 4,819,562 | A | * | 4/1989 | Bowman | 102/281 |
| 5,208,420 | A | * | 5/1993 | Hamilton et al. | 102/281 |
| 5,471,903 | A | * | 12/1995 | Brede et al. | 89/1.14 |
| 5,544,800 | A | * | 8/1996 | Armstrong | 227/9 |
| 5,842,623 | A | * | 12/1998 | Dippold | 227/10 |
| 6,327,978 | B1 | * | 12/2001 | Turano et al. | 102/202.7 |

FOREIGN PATENT DOCUMENTS

| | | |
|---|---|---|
| DE | 2324183 | 11/1974 |
| DE | 9824122 | 12/1999 |
| DE | 9905549 | 8/2000 |
| FR | 0520515 | 6/1921 |

* cited by examiner

*Primary Examiner*—Michael J. Carone
*Assistant Examiner*—M. Thomson
(74) *Attorney, Agent, or Firm*—Sidley Austin Brown & Wood, LLP

(57) ABSTRACT

A cartridge magazine for explosive powder charge-operated setting tools including a charge-receiving member (2, 12, 22) having a plurality of spaced from each other, charge-receiving chambers (3, 13, 23) for receiving propellant charges (6, 16, 26), respectively, and a bottom (1, 11, 21) for closing the charge-receiving chambers (3, 13, 23) and formed of a heat-releasing, fusible and current-conducting foil.

10 Claims, 2 Drawing Sheets

Fig. 1
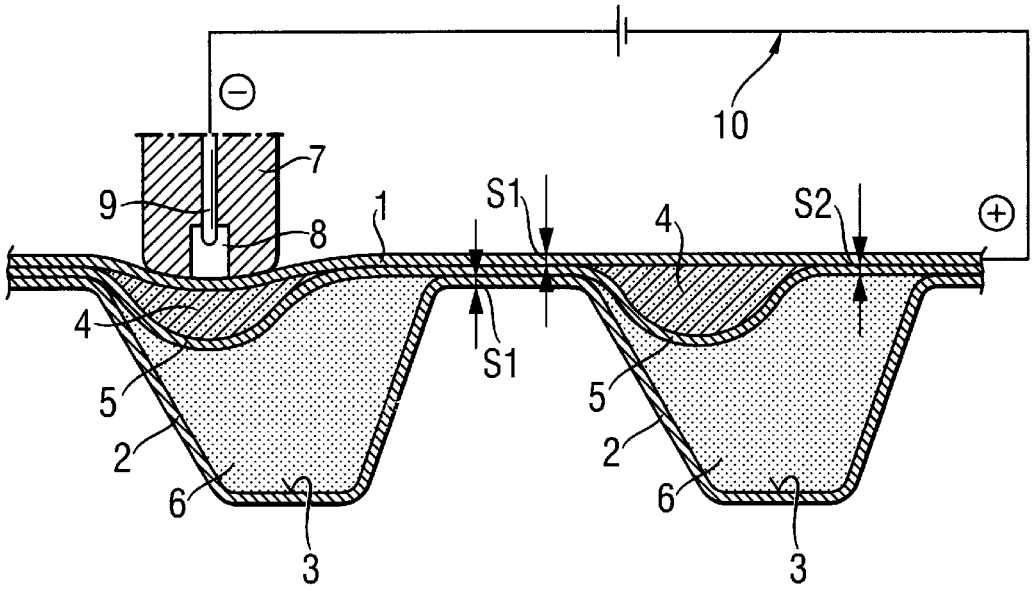
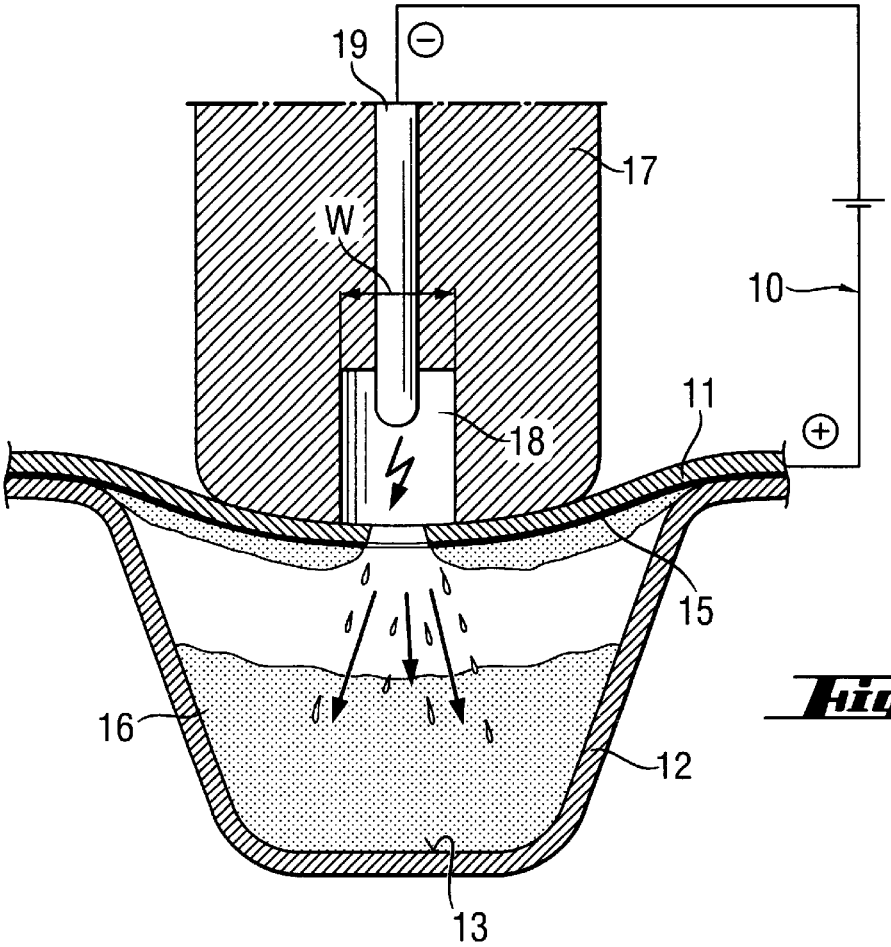
Fig. 2

CARTRIDGE MAGAZINE

BACKGROUND OF THE INVENTION

1. Field of the Invention

The present invention relates to a cartridge magazine for explosive powder charge-operated setting tools including a charge-receiving member having a plurality of spaced from each other, charge-receiving chambers for receiving propellant charges, respectively, and a bottom for closing the charge-receiving chambers.

2. Description of the Prior Art

German Publication DE-OS 23 24 183 discloses a cartridge magazine having a charge-receiving member with a plurality of spaced from each other, propellant charge-receiving chambers. Each of the chambers is covered by a thin bottom. A propellant charge is located inside each of the chambers. A heating wire, which is connected with a source of electrical current and which ignites the propellant charge upon being heated, is embedded into the propellant charge.

A proper insertion of the heating wire into the propellant charge-receiving chamber cannot be effected economically. Further, the formation of an electrical connection between the current source and the heating wire is associated with substantial difficulties.

Accordingly, an object of the present invention is to provide a cartridge magazine that can be economically produced.

Another object of the present invention is to provide a cartridge magazine in which the propellant charges can be electrically ignited in a simple manner, with simple means, and reliably.

SUMMARY OF THE INVENTION

These and other objects of the present invention, which will become apparent hereinafter, are achieved, according to the present invention, by forming the bottom, which covers the propellant charge-receiving chambers, of a heat-releasing, fusible and current-conducting foil.

The formation of the bottom according to the present invention provides for localized melting of the foil and a reliable ignition of the propellant charge with droplets of the hot melt.

A reliable localized heating with subsequent melting is achieved when the bottom is formed of a foil having a thickness, preferably, from 0.1 mm to 0.5 mm.

In order to insure that in the cartridge magazine the separate chambers of which contain a small amount of a propellant charge, a sufficient amount of the propellant charge is provided in the region of the bottom, preferably, the side of the bottom adjacent to the chambers is provided with a glue layer. Particles of the propellant charge adhere to this glue layer, e.g., when the cartridge magazine is subjected, during transportation, to vibrations that cause swirling inside the propellant charge-receiving chamber.

Improved ignition of the propellant charge is preferably achieved when an ignition-supporting, initiating charge is provided in the propellant charge-receiving chamber in its bottom region.

In order to be able to use, e.g., a powdery initiating charge and to prevent its mixing with the propellant charge, e.g., upon occurrence of vibrations, a separation layer, which separates the initiating charge from the propellant charge, extends, preferably, at least in the region of the propellant charge-receiving chamber, between the bottom and the propellant charge-receiving member.

For manufacturing reasons, advantageously, the separation layer has a thickness from 0.02 mm to 0.5 mm.

A particularly good localized heating and melting of the bottom is achieved when, preferably, the bottom is formed of aluminum.

In order to be able to achieve a localized melting of the foil, the foil cooperates with two electrical contacts of a source of an electrical current of which one contact is formed as an electrode, which is received in and is guided by an insulator connectable with the bottom. The second contact is connected with the bottom itself. Thus, the electrical current flows through both the electrode and the bottom. The insulator keeps the electrode spaced form the bottom in order to insure that an electric arc can be formed between the electrode and the bottom upon flow of the electrical current therethrough. A large amount of heat is released in the electric arc region which is sufficient for melting the foil in the electrode region.

The foil can be so dimensioned that its resistance becomes a dominating resistance of the electrical circuit. In this way, the electric energy, which is provided by the electrical current source, is primarily used for melting the foil.

Upon melting of the foil, a portion of the melt is evaporated. The expandable gas generates a steam pressure which displaces droplets of the melt towards the powdery propellant charge causing its ignition.

An increase of the available electrical energy is achieved by combustion of gases which are formed during melting of the foil. The necessary oxygen becomes available due to formation at the free end of the insulator an expansion chamber, which is open at the free end and into which preferably the electrode extends.

In order to be able to increase the flow velocity of the expandable gas leaving the expansion chamber, advantageously, the inner width of the expansion chamber diminishes toward the free end of the insulator.

In order to be able to additionally heat the gas formed during the evaporation of the foil, care should be taken to insure that it flows from the insulator toward the foil and is carried through the electric arc. This provides for additional heating of the gas which increases the flow velocity and the speed of movement of melt droplets toward the propellant charge. In order to insure that the expandable gases are carried only through the electrical arc, the smallest inner width of the expansion chamber is so selected that it corresponds to the cross-section of the electrode which extends parallel to the inner dimension of the expansion chamber.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS

The drawings show:

FIG. 1 a cross-sectional view of a portion of a cartridge magazine according to the present invention, with an insulator applying pressure to the bottom portion of the magazine;

FIG. 2 a cross-sectional view of a single section of the cartridge magazine according to the present invention at an increased scale.

DETAILED DESCRIPTION OF THE PREFERRED EMBODIMENT

Figure 3:
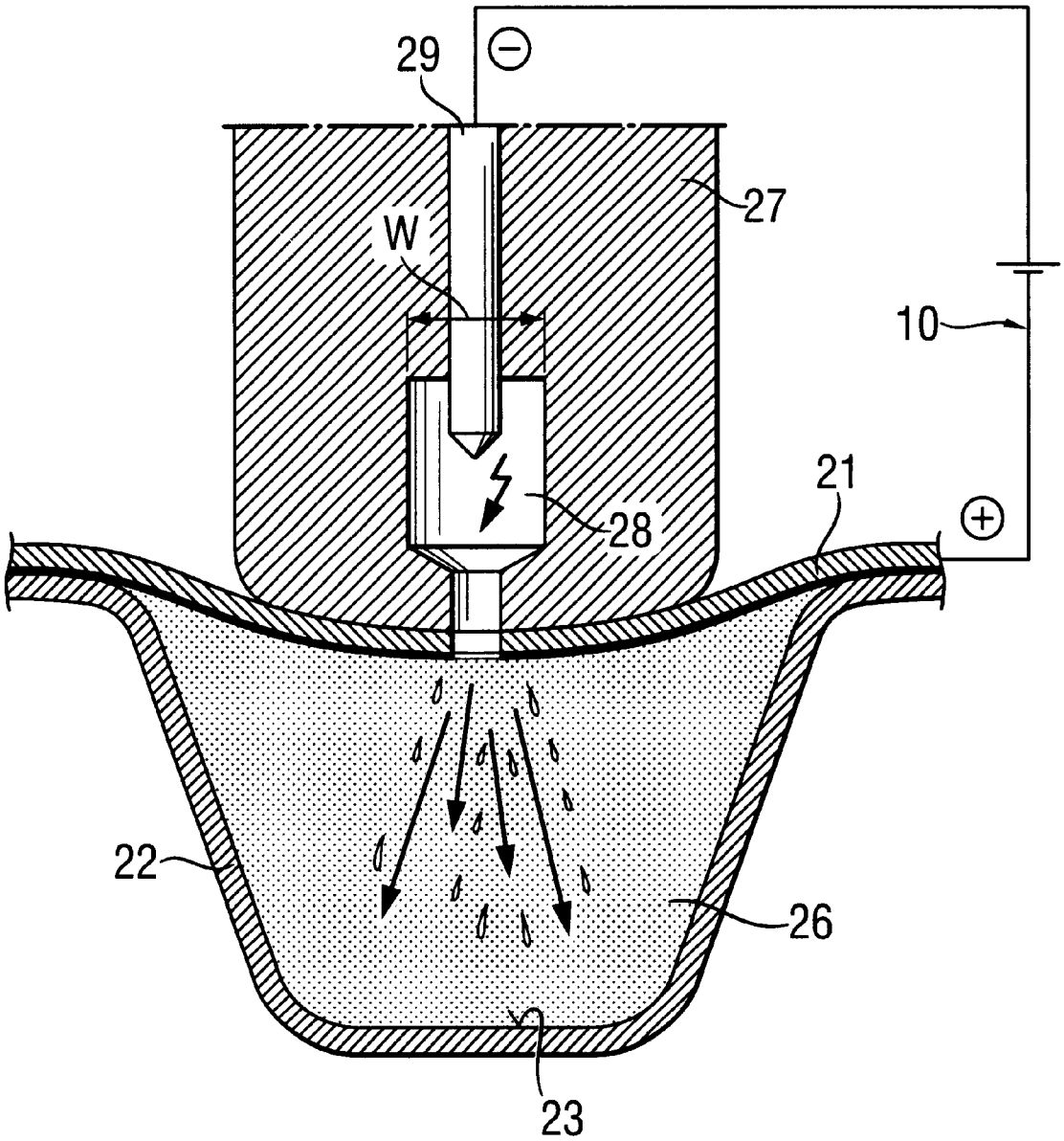
FIG. 3 a cross-sectional view of a single section of another embodiment of a cartridge magazine according to the present invention at an increased scale.

A cartridge magazine according to the present invention, which is shown in FIGS. 1–3, includes a bottom 1, 11, 21, a strip-shaped charge-receiving member 2, 12, 22, and spaced from each other, charge-receiving chambers 3, 13, 23. The receiving chambers 3, 13, 23 have a shape of a truncated cone, with the largest width of the chambers 3, 13, 23 being covered with the bottom 1, 11, 21. The bottom 1, 11, 21 is formed of a thin, fusible, current-conducting foil, e.g., formed of aluminum or titanium. The bottom 1, 11, 21 and the charge-receiving member 2, 12, 22 have a wall thickness from 0.1 mm to 0.5 mm. The charge-receiving member 2, 12, 22 can likewise be formed of aluminum, titanium, thermoplastic material, or paper which is, e.g., water-impermeable. Inside each charge-receiving chamber 3, 13, 23, e.g., a powdery propellant charge 6, 16, 26 is located.

From outside, a pressure is applied to the bottom 1, 11, and 21 by an insulator 7, 17, 27, respectively, connected with a setting tool (not shown). The insulator 7, 17, 27 has an expansion chamber 8, 18, 28 which is open at the free end of the insulator 7, 17, 27 that is connected with the bottom 1, 11, 21. The insulator 7, 17, 27 receives and guides an electrode 9, 19, 29 that partially projects into the interior W of the expansion chamber 8, 18, 28. The free end of the electrode 9, 19, 29 is spaced from the bottom 1, 11, 21. As shown, in particular, in FIG. 1, the electrode 9 and the bottom 1 are connected with contacts (–) and (+), respectively, of an electrical current source 10.

As shown in FIG. 1, inside of the charge-receiving chamber 3 in the region of the bottom 1, there is provided an initiating charge 4 that promotes the ignition of the propellant charge 6. The initiating charge 4 is separated from the propellant charge 6 by a thin separating layer 5. The thickness S2 of the separating layer 5 amounts from 0.02 mm to 0.5 mm. The separating layer 5 can likewise be formed of aluminum, titanium, thermoplastic material, or water-impermeable paper. The charge-receiving member 2 and the separating layer 5 can, e.g., be glued to each other.

As shown in FIG. 2, the side of the bottom 1 adjacent to the charge-receiving member 12 has a glue layer 15. The glue layer 15 connects the bottom 11 with the charge-receiving member 12 after the charge-receiving chamber 13 is filled with the propellant charge 16. The advantage of providing a glue layer 15 also consists in that the particles of the propellant charge 16 can be bonded to the bottom 11, improving thereby the ignition process. This is particularly important when in cartridge magazines having a smaller power, a small amount of the propellant charge 16 is located in the charge-receiving chamber 13.

The ignition takes place upon flow of an electrical current through the electrode 9, 19, 29 and the bottom 1, 11, 21. An electrical arc, which is formed between the bottom 11, 21 and the electrode 19, 29, releases a large amount of heat which melts the bottom 11, 21 and finally, evaporates it. The steam pressure causes the movement of droplets of the melt toward the propellant charge 16, 26, which is located in the charge-receiving chamber 13, 23 and the propellant charge 16, 26 is ignited.

In the embodiment shown in FIG. 3, the inner dimension of the expansion chamber 28 diminishes toward the bottom 21, with the smallest inner diameter W of the expansion chamber 28 corresponding to the cross-section of the electrode 29.

Accordingly, though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. An explosive powder charge-operated setting tool for use with a cartridge magazine having a charge-receiving member (2) having a plurality of spaced from each other, charge-receiving chambers (3, 13, 23) for receiving propellant charges (6, 16, 26), respectively, and a bottom (1, 11, 21) for closing the charge-receiving chambers (3, 13, 23) and formed of a heat-releasing, fusible and current-conducting foil, the setting tool comprising an electrical current source (10) having electrical positive and negative contacts; an electrode (9, 19, 29) connected with one of the positive and negative contacts; an insulator (7, 17, 27) for receiving and guiding the electrode (9, 19, 29) and which can be connected with the bottom (1) of the cartridge magazine; and conductor means for connecting another of the positive and negative contacts with the bottom (1), wherein the insulator (7, 17, 27) has an expansion chamber (8, 18, 28) open at a free end of the insulator (7, 17, 27), the electrode (9, 19, 29) projecting into the expansion chamber (8, 18, 28).

2. A setting tool according to claim 1, wherein an inner width of the expansion chamber (28) diminishes toward the free end of the insulator (27).

3. A cartridge magazine for explosive powder charge-operated setting tools, comprising a charge-receiving member (2, 12, 22) having a plurality of spaced from each other, charge-receiving chambers (3, 13, 23) for receiving propellant charges (6, 16, 26), respectively; and a bottom (1, 11, 21) for closing the charge-receiving chambers (3, 13, 23) and formed of a heat-releasing, fusible and current-conducting foil for forming, upon firing of a setting tool, hot droplets for igniting the propellant charges.

4. A cartridge magazine according to claim 3 wherein the foil, of which the bottom (1, 11, 21 ) is formed, has a thickness from 0.1 mm to 0.5 mm.

5. A cartridge magazine according to claim 3, wherein a side of the bottom (1, 11) adjacent to the charge-receiving chambers is provided with a glue layer (15).

6. A cartridge magazine according to claim 3, wherein each charge-receiving chamber (3), there is provided an initiating charge (4) connected with the bottom (1).

7. A cartridge magazine according to claim 6, wherein a separation layer (5), which separates the initiating charge (4) from the propellant charge (6), extends between the bottom (1) and the charge-receiving member (2).

8. A cartridge magazine according to claim 7, wherein the separation layer (5) has a thickness (S2) from 0.02 mm to 0.5 mm.

9. A cartridge magazine according to claim 3, wherein the bottom (1, 11, 21) is formed of aluminum.

10. An explosive power charge-operated setting tool for use with a cartridge magazine having a charge-receiving member (2) having a plurality of spaced from each other, charge-receiving chambers (3, 13, 23) for receiving propellant charges (6, 16, 26), respectively, and a bottom (1, 11, 21) for closing the charge-receiving chambers (3, 13, 23) and formed of a heat-releasing, fusible and current-conducting foil for forming, upon firing of a setting tool, not droplets for igniting the propellant charges, the setting tool comprising an electrical current source (10) having electrical positive and negative contacts; an electrode (9, 19, 29) connected with one of the positive and negative contacts; an insulator (7, 17, 27) for receiving and guiding the electrode (9, 19, 29) and which can be connected with the bottom (1) of the cartridge magazine; and conductor means for connecting another of the positive and negative contacts with the bottom (1) for fusing the bottom upon firing of the setting tool.

* * * * *